US006071664A

United States Patent [19]

Tavernier et al.

[11] Patent Number: 6,071,664

[45] Date of Patent: Jun. 6, 2000

[54] TONER PARTICLES CONTAINING A MIXTURE OF A MODIFIED LINEAR POLYMER, A CROSS-LINKED POLYMER AND A WAX

[75] Inventors: Serge Tavernier, Lint; Werner Op de Beeck, Putte; Stefaan de Meutter, Antwerp; Geert Tersago, Puurs, all of Belgium

[73] Assignee: Agfa-Gevaert, N.V., Mortsel, Belgium

[21] Appl. No.: 09/177,504

[22] Filed: Oct. 23, 1998

Related U.S. Application Data

[60] Provisional application No. 60/068,528, Dec. 22, 1997.

[30] Foreign Application Priority Data

Oct. 31, 1997 [EP] European Pat. Off. ..... 97203377

[51] Int. Cl.[7] ..... G03G 9/087

[52] U.S. Cl. ..... 430/109; 430/124

[58] Field of Search ..... 430/106, 109, 430/99, 124

[56] References Cited

U.S. PATENT DOCUMENTS

| | | | |
|---|---|---|---|
| 5,344,737 | 9/1994 | Berkes et al. . | |
| 5,578,409 | 11/1996 | Kotaki et al. . | |
| 5,587,265 | 12/1996 | Nakadera et al. . | |
| 5,629,121 | 5/1997 | Nakayama . | |
| 5,712,074 | 1/1998 | Sato et al. | 430/109 |
| 5,738,965 | 4/1998 | Nakadera et al. . | |
| 5,756,244 | 5/1998 | Omatsu et al. . | |
| 5,853,940 | 12/1998 | Kido et al. | 430/109 |

FOREIGN PATENT DOCUMENTS

| | | |
|---|---|---|
| 0 276 147 A2 | 7/1988 | European Pat. Off. . |
| 0 276 147 A3 | 7/1988 | European Pat. Off. . |
| 0 298 279 A2 | 1/1989 | European Pat. Off. . |
| 0 606 873 A1 | 7/1994 | European Pat. Off. . |
| 0 662 640 A2 | 7/1995 | European Pat. Off. . |
| 0 662 640 A3 | 7/1995 | European Pat. Off. . |
| 0 712 881 A1 | 5/1996 | European Pat. Off. . |
| 0 716 351 A2 | 6/1996 | European Pat. Off. . |
| 0 725 319 A1 | 8/1996 | European Pat. Off. . |
| 0 740 217 A1 | 10/1996 | European Pat. Off. . |
| 0 716 351 A3 | 10/1997 | European Pat. Off. . |
| 195 20 580 A1 | 12/1995 | Germany . |

*Primary Examiner*—John Goodrow
*Attorney, Agent, or Firm*—Breiner & Breiner

[57] ABSTRACT

Dry toner particles with a resinous matrix containing a mixture of a polymer (LPC) with low softening point and tgδ>3, modified by a modifier (D) selected from the group consisting of long chain aliphatic compounds with a reactive end group and having between 20 and 250 carbon atoms and a polysiloxane, said modifier and said polymer being present in a molar ratio LPC/D between 0.8 and 1.25 and a non-linear polymer with a softening point $T_{sB}$ such that 110° C. $\leqq T_{sB} \leqq 135°$ C. The toner particles further contain a wax chosen from waxes having a melting point near to the softening point of the branched polymer B.

17 Claims, No Drawings

TONER PARTICLES CONTAINING A MIXTURE OF A MODIFIED LINEAR POLYMER, A CROSS-LINKED POLYMER AND A WAX

This application claims benefit of provisional application Ser. No. 60/068,528 Dec. 22, 1997.

FIELD OF THE INVENTION

The present invention relates to dry toner particles, especially to dry toner particles useful in eletrostatographic or magnetographic imaging methods wherein the toner particles are fixed to the final image receiving member by simultaneous application of heat and pressure.

BACKGROUND OF THE INVENTION

In imaging methods as e.g. electro(photo)graphy, magnetography, ionography, etc. a latent image is formed that is developed by attraction of so called toner particles. In DEP the so called toner particles are image-wise deposited on a substrate. Toner particles are basically polymeric particles comprising a polymeric resin as main component and various ingredients mixed with said toner resin. Apart from colourless toners, which are used e.g. for finishing function, the toner particles comprise at least one black and/or colouring substances, e.g., coloured pigment.

In the different imaging methods, described above, the toner particles can be present in a liquid or in a dry developer composition.

In most cases the use of dry developer compositions is preferred. The main advantage of using a dry developer composition resides in the absence of the need to eliminate the liquid phase after development. The avoidance of the need to evacuate (mainly organic) liquids is desirable both from an economical standpoint and from an ecological standpoint.

After development of the latent image (in e.g. electro (photo)graphy, magnetography, ionography, etc.) the developed image is transferred to a substrate. In DEP (direct electrostatic printing) the toner image is directly deposited on the substrate.

The visible image, on this substrate, of electrostatically or magnetically attracted toner particles is not permanent and has to be fixed by causing the toner particles to adhere to each other and the substrate by softening or fusing them followed by cooling. Normally fixing proceeds on more or less porous paper by causing or forcing the softened or fused toner mass to penetrate into the surface irregularities of the paper.

There are different types of fusing processes used for fusing a toner powder image to its support. Some are based upon fixation primarily on fusing by heat, others are based on softening by solvent vapours, or by the application of cold flow at high pressure in ambient conditions of temperature. In the fusing processes based on heat, two major types should be considered, the "non-contact" fusing process and the "contact" fusing process. In the non-contact fusing process there is no direct contact of the toner image with a solid heating body.

In "contact" fusing the support carrying the non-fixed toner image is conveyed through the nip formed by a heating roller also called fuser roller and another roller backing the support and functioning as pressure exerting roller, called pressure roller. This roller may be heated to some extent so as to avoid strong loss of heat within the copying cycle. The last mentioned fusing process has been employed widely in low-speed as well as high-speed fusing systems, since a remarkably high thermal efficiency is obtained because the surface of the heating roller is pressed against the toner image surface of the sheet to be fixed. This fusing system has to be monitored carefully in that when the fuser roller provides too much thermal energy to the toner and paper, the toner will melt to a point where its melt cohesion and melt viscosity is so low that "splitting" will occur, and some of the toner is transferred to the fuser roller from where the toner stain may be transferred in a next copying cycle on a next copy sheet whereon it may be deposited; such phenomenon is called "hot-offset", and requires appropriate cleaning. In order to avoid these phenomena an external release agent, e.g., silicone oil, wetting the fuser roller can be used. The application of an external liquid release agent represents an extra consumable and requires apparatus adaptation making it more expensive. Tee release agent will inevitably also transfer to the copy paper and may produce prints having a fatty touch and gloss unevenness due to the presence of oil.

Therefore it is preferred to use in the toner particles, designed to be fixed in a "contact" process, special resins and/or special additives for minimising the need of external release agent or for totally avoiding the use of such an agent.

Several proposition have been made in the art. All of these propositions do, to a larger or smaller extent, overcome the problems with fixing of toner particles in "contact" fusing processes.

It has been disclosed in EP-A-276 147 to add long chain aliphatic alcohols as a wax component to the toner particles for avoiding the problems cited above. In that disclosure it is suggested that, when such an alcohol is added, any ordinary toner resin can be used. Also in JP-A-5967554 the addition of long chain compounds to toner particles has been disclosed.

In U.S. Pat. No. 5,344,737 it has been disclosed to add a component with formula $H_3C—(—CH_2)_n—(—O—CH_2—CH_2)_m—OH$, with $30 \leqq n \leqq 50$ and $3 \leqq m \leqq 16$ to a toner composition for avoiding the hot-offset phenomenon.

It has also be proposed, in e.g., DE-A-195 20 580, to use polyesters as toner resin that comprise moieties derived from a long chain aliphatic dicarboxylic acid (e.g. eicosanedicarboxylic acid) or that contain long chain mono-carboxylic acid. Also in U.S. Pat. No. 5,578,409 the use of polyester toner resins modified by long chain aliphatic acids or alcohols are described. In EP-A-712 881 the modification of an amorphous polymer by two different long chain aliphatic acids or alcohols has been described.

In EP-A-298 279 it is disclosed to blend multiphase polyorganosiloxane block or graft condensation copolymers in the toner resin. In EP-A-740 217 the modification of a polymer for use in toner particles by a reacting a polymer containing free hydroxyl or acid groups with specified polysiloxanes has been disclosed.

In EP-A-716 351 toner particles are disclosed comprising a high softening point polyester, a low softening point polyester and a long-chain alkyl compound selected from the group consisting of long chain alcohols with 23 to 252 carbon atoms and long chain acid with 22 to 251 carbon atoms. Also toner particles are disclosed comprising as toner resin a mixture of high softening point polyester, a low softening point polyester and a polyester modified by reacting it with a long-chain alkyl compound selected from the group consisting of long chain alcohols with 23 to 252 carbon atoms and long chain acid with 22 to 251 carbon atoms. Toner particles with such toner resin are very resistant to hot-offset.

The disclosures above make it possible to produce dry toner particles with acceptable to good hot-offset properties (i.e. do show very low hot-offset). Toner particles need to have other properties together with the hot-offset properties. During use toner particles are also exposed to severe mechanical stresses, e.g. during mixing, transport trough the devices, by doctor blades regulating the thickness of a toner layer, etc. When toner particles are used in full-colour development the particles must have a very good fluidity during fixing for good interflow of the four colours (Y,M, C,K) and still show good hot-offset properties. A similar good melt fluidity is essential when the grey scale (tonal range) in a black and white electrostatographic image fixed to a final substrate, is extended by realising the necessary different shades of grey with the superposition of toner particles comprising different amounts of black pigment as disclosed in EP-A-768 577. In such image an undesirably high surface relief, making the image very sensitive to scratches can be present, unless there is a very good interflow of the toner particles when fused.

Therefore there is still a need for toner particles that combine good hot-offset properties even with a very low amount of external release agent, and that at the same time are strong enough to withstand the mechanical stresses and have good fluidity when molten.

OBJECTS AND SUMMARY OF THE INVENTION

It is an object of the present invention to provide dry toner particles that combine high mechanical strength and good fluidity at elevated temperature with good hot-offset properties.

It is a further object of the invention to provide toner particles that can be used in an electrostatographic or magnetographic imaging process that includes a "contact" fusing step for fixing the image to the final substrate.

It is a further object of the invention to provide toner particles useful in a full colour imaging process wherein the colours of the original are faithfully rendered.

It is a further object of the invention to provide a method for electrostatographic or magnetographic imaging wherein dry toner particles are fixed to a final image receiving member by "contact" fusing means comprising heated roller, wherein on said heated rollers no or only a minimal amount of external release agent for avoiding hot-offset has to be present.

Other objects and advantages of the invention will become clear from the detailed description hereinafter.

The objects of this invention are realised by providing dry toner particles comprising a resinous matrix and a wax, characterised in that said resinous matrix contains a mixture of a polymer (LPC) with weight average molecular weight ($M_w$) between 2,000 and 20,000, a tgδ>3 at 120° C. and 100 rad/sec and a low softening point $T_{sLPC}$ such that 90° C.≦$T_{sLPC}$≦120° C., modified by a modifier (D) selected from the group consisting of long chain aliphatic compounds with a reactive end group and having between 20 and 250 carbon atoms and a polysiloxane, said modifier and said polymer being present in a molar ratio LPC/D between 0.8 and 1.25and a non-linear polymer with a softening point $T_{sB}$ such that 110° C.≦$T_{sB}$≦135° C. making up at least 25% by weight of said resinous matrix, and said wax has a melting point $M_p$ so that 85° C.≦$M_p$≦135° C. and $M_p$≦$T_{sB}$+10.

DEFINITION

When in this document it is said that the Hildebrand solubility factor of two compounds (e.g. of compounds C and D) are equal (i.e. $\delta_C=\delta_D$ it is meant that the factors differ less than 2 $J^{1/2}/cm^{3/2}$.

When in this document it is said that the Hildebrand solubility factors of two compounds (e.g., compound A and B) are different (i.e. $\delta_B\neq\delta_A$) it is meant that the factors differ more than 2 $J^{1/2}/cm^{3/2}$.

The wording "non-linear polymers" is used to indicate both heavily branched polymers and totally or partially cross-linked polymers.

DETAILED DESCRIPTION OF THE INVENTION

In electrostatographic (electrophotography, ionography, direct electrostatic printing (DEP)) or magnetographic imaging apparatus wherein dry toner particles are used to form an image on a final substrate and wherein the toner particles are fixed on the substrate in a contact fusing station comprising heated rollers, it is desired that very simple contact fusing means can be used. The simpler the fusing means, the less expensive, the smaller and the more reliable they can be made. However the problem of hot-offset (adhesion of toner particles on the fusing rollers instead of on the final substrate) often dictates the use of complicated fusing station incorporating means for applying an external release agent on the image and means for metering the amount of release agent that is applied. When in the imaging systems toner particles with good anti-hot-offset properties are used it is possible to simplify the fusing station. Ways and means for making toner particles with good anti-offset properties were already described in the background art section of this document and are described in, e.g., EP-A-276 147, JP-A-5967554, U.S. Pat. No. 5,344,737, DE-A-195 20 580, EP-A-712 881, EP-A-298 279, EP-A-740 217, etc.. When toner particles are used in full-colour development the particles must have a very good fluidity during fixing for good interflow of the four colours (Y,M,C,K) and still show good anti-hot-offset properties. The same goes for images wherein the grey scale (tonal range) in a black and white (monochrome) electrostatographic image fixed to a final substrate, is extended by realising the necessary different shades of grey with the superposition of toner particles comprising different amounts of (black) pigment as disclosed in EP-A-768 577. Combining in toner particles a good fluidity when molten with good anti-hot-offset properties is not so straight forward.

It was now after experimentation found that toner particles comprising a resinous matrix and a wax, wherein in said resinous matrix a polymeric chain (polymer LPC) with a weight average molecular weight ($M_w$) between 2,000 and 20,000, a tgδ>3 at 120° C. and 100 rad/sec and with a fairly low softening point, $T_{sLPC}$ such that 90° C.≦$T_{sLPC}$≦120° C. and being modified with a long chain compound (compound D) to form polymer A,,is present together with a heavily branched or (partially) cross-linked polymer (polymer B) with a softening point, $T_{sB}$ such that 110° C.≦$T_{sB}$≦135° C. and wherein said wax (compound C) has a melting point $M_p$ related to the softening point of the polymers such that 85° C.≦$M_p$≦135° C. and $M_p$≦$T_{sB}$+10, did show good anti-offset properties combined with good interflow during fusing. Viscosities and tgδ wer measured in a CARRI MED Rheometer CSL 500 available through TA-Instruments, USA.

In a preferred embodiment said resinous matrix contains at least 50% by weight with respect to the total weight of the resinous matrix of said polymer LPC modified by said compound D and said non-linear polymer B.

In a more preferred embodiment of the invention said resinous matrix of the toner particles consists of said mixture of said polymer LPC modified by said compound D and said non-linear polymer B.

Preferably said polymer, LPC, with a tgδ>3 at 120° C. and 100 rad/sec is a linear polymer.

It was surprisingly found that toner particles with a wax and a resinous matrix containing a polymer with a tgδ>3 at 120° C. and 100 rad/sec and being modified by compound D and a non-linear polyester did not show the same good quality with respect to interflow during fusing and anti-offset properties as toner particles having a wax and a resinous matrix according to this invention.

It was further found, that the interflow of the toner particles could be enhanced and the gloss of the resulting toner images could easily be controlled to give a satin look, when polymer LPC, compound D, polymer B and compound C have Hildebrand solubility factors in a specific range and in relation to each other. Such toner particles combined good anti-hot-offset properties, good fluidity in molten state and good physical strength.

The notion HILDEBRAND solubility parameter is described in the book "The Solubility of Non-electrolytes" by J. H. Hildebrand and R. L. Scott, Dover Publications, Inc., New York, 3th. ed. (1964) and in the book "Properties of Polymers" by D. W. Van Krevelen, 2nd. ed., Elseviers Scientific Publishing Company, New York, 1976, Chapter 7.

In particular the resinous matrix of toner particles according to this invention contains a polymer LPC modified with compound D, a polymer B and a compound C, characterised in that:

said polymer LPC is a polymer having a weight average molecular weight ($M_w$) between 2,000 and 20,000, a tgδ>3 at 120° C. and 100 rad/sec and low softening point $T_{sLPC}$ such that 90° C.$\leqq T_{sLPC} \leqq$120° C., modified by a modifier (D) selected from the group consisting of long chain aliphatic compounds with a reactive end group and having between 20 and 250 carbon atoms and a polysiloxane, and the molar fraction of LPC/D being such that $0.8 \leqq LPC/D \leqq 1.25$, said polymer B has a viscoelastic loss tgδ such that $1.0 \leqq tg\delta \leqq 2.5$ measured at 120° C. and at 100 rad/sec, a softening point $T_{sB}$ such that 110° C.$\leqq T_{sB} \leqq$135° C. , and makes up at least 25% by weight of said resinous matrix, said compound C has a melting point $M_p$ so that 85° C.$\leqq M_p \leqq$135° C. and $M_p \leqq T_{sB}+10$, and a softening point $T_{sC}$ such that $T_{sC} \leqq T_{sB}+20$° C. , an Hildebrand solubility parameter $\delta_C$ so 15 $J^{1/2}/cm^{3/2} \leqq \delta C \leqq 19$ $J^{1/2}/cm^{3/2}$ and said polymer B, said polymeric chain LPC and said compounds C and D have a Hildebrand solubility parameter δ such that $\delta_C=\delta_D<\delta_{LPC}=\delta_B$.

Preferably $\delta_C$ is between 15 and 19 $J^{1/2}/cm^{3/2}$ and $\delta_D$ between 15 and 18$J^{1/2}/cm^{3/2}$, $\delta_{LPC}$ between 19 and 22 $J^{1/2}/cm^{3/2}$, and $\delta_B$ between 19 and 22 $J^{1/2}/cm^{3/2}$. It is preferred that $\delta_C$ and $\delta_D$ are equal, in this document this means that they do not differ more than 2 $J^{1/2}/cm^{3/2}$. It is also preferred that $\delta_C$ and $\delta_D$ do not differ more than 2 $J^{1/2}/cm^{3/2}$, It is preferred that $\delta_C=\delta_D$ and that both are 2 units (2 $J^{1/2}/cm^{3/2}$) lower than $\delta_{LPC}=\delta_B$. It is preferred that the difference between the δ's is not larger than 6 units (6 $J^{1/2}/cm^{3/2}$). When the difference was larger a the compounds of the resinous matrix became incompatible and an image printed with toner particles with such a matrix was matte and dull. On the other hand a slight incompatibility (expressed by the difference in Hildebrand solubility factor being between 2 and 6 units) had a beneficial effect on the look of the image since a very pleasing satin look was obtained. This effect has been described in EP-A-656 129.

Said polymer chain LPC, with a tgδ>3 at 120° C. and 100 rad/sec can be any polymer known in the art as long as it comprises at least one reactive end group. Preferably said polymeric chain LPC is a linear polymeric chain. It can, e.g., be an addition polymer comprising a carboxyl group at the end, such as Co(Styrene/n-butylmethacrylate), diCOOH terminated (65/35), a polyester, an epoxy resin or a mixed polycondensate (block or random polymer) comprising polyester and polyamide moieties. Linear mixed polycondensates, comprising polyester and polyamide moieties, can be prepared by copolycondensation of at least one di-carboxylic acid, at least one diol, and at least one aliphatic diamine or aminocarboxylic acid or a lactam. Said diamine, aminocarboxylic acid or lactam is present in the polycondensation mixture for at most 30% mol for mol. Examples of useful diamines, aminocarboxylic acids or lactam are e.g. hexamethylene diamine, pentamethylene diamine, tetramethylene diamine, 11-amino-undecanoic acid, ε-caprolactam, etc.

Expoxy resins, useful as polycondensation backbone in a complex macromolecule according to the present invention, are linear adduct of bis-phenol A and epichlorhydrin having a Tg of about 54° C.

Preferably applied epoxy resins are linear adducts of bisphenol compounds and epichlorhydrin as described e.g. by D. H. Solomon in the book "The Chemistry of Organic Film Formers"—John Wiley & Sons, Inc., New York (1967) p. 180–181, e.g. EPIKOTE 1004 (EPIKOTE is a registered trade mark of the Shell Chemical Co).

In the most preferred embodiment of this invention, the polymer chain LPC, used to form polymer A after reaction with long chain aliphatic compound D, is a homo- or copolyester. Said homo- or copolyesters (hereinafter termed polyester) can be produced by any known polycondensation reaction between at least one dicarboxylic acid and one diol. The polyester, used according to this invention can comprise aromatic dicarboxylic acid moieties. The polyester, used according to this invention can comprise aromatic dicarboxylic acid moieties. Examples of aromatic dicarboxylic acid moieties are moieties of terephthalic acid, isophthalic acid, naphthalene dicarboxylic acids, 4,4' diphenylene dicarboxylic acid, 4,4' diphenylether dicarboxylic acid, 4,4' diphenylmethane dicarboxylic acid, 4,4' diphenylsulphodicarboxylic acid, 5-sulphoisophthalic acid, etc. and mixtures of these acid moieties.

Polyesters, to be used as polymer chain LPC, according to the present invention, can also comprise aliphatic dicarboxylic acid moieties. It may comprise saturated aliphatic dicarboxylic acid moieties derived from, e.g., malonic acid, succinic acid, glutaric acid, adipic acid, etc. and/or unsaturated aliphatic carboxylic acid moieties derived from, e.g., maleic acid, fumaric acid, etc.

Polyesters, useful as polymer chain LPC, according to the present invention, have a minimum Tg (glass transition temperature) of 45° C. Any polyester resin having a Tg higher than 45° C. can be used. Preferred polyester resins are linear polycondensation products of (i) difunctional organic acids, e.g. maleic acid, fumaric acid, terephthalic acid and isophthalic acid and (ii) difunctional alcohols such as ethylene glycol, triethylene glycol, an aromatic dihydroxy compound, preferably a bisphenol such as 2,2-bis(4-hydroxyphenyl)-propane called "bisphenol A" or an alkoxylated bisphenol, e.g. propoxylated bisphenol examples of which are given in U.S. Pat. No. 4,331,755. For the preparation of suitable polyester resins reference is made to GB-P 1,373,220.

Since it is preferred to use linear polymers as polymeric chain LPC in a resinous matrix of toner particles of this invention, interesting linear polyesters are commercial products such as ATLAC T500 (which is a trade name of Atlas Chemical Industries Inc. Wilmington, Del. U.S.A.) and ATLAC T500 is a linear polyester of fumaric acid and propoxylated bisphenol A, having a Tg of about 55° C., a $T_{sp}$ of 100° C., an average numerical molecular weight ($M_n$) of 4,000 and a weight average molecular weight ($M_w$) of 12,000. This polymer is described in e.g. NL 71/16891.

Another useful commercial product for use as a linear polymer chain, according to the present invention, is DIACRON FC150 a trade name of Mitsubishi Rayon, Japan for a linear polyester resin produced by the polycondensation of terephthalic acid, propoxylated bisphenol A and ethylene glycol, having a $T_{sp}$ of 110° C., an average numerical molecular weight ($M_n$) of 3,700 and a weight average molecular weight ($M_w$) of 12,000.

A further interesting linear polyester for use as linear polymer chain in this invention is a linear bisphenol A based saturated polyester sold under trade name ALMACRYL P-501 by Image Polymers Europe, having a Tg between 52 and 56° C., a Tsp of 95° C., an average numerical molecular weight ($M_n$) of 3,500 and a weight average molecular weight ($M_w$) of 8,000.

Other interesting linear polyesters are polycondensation products of terephthalic acid, isophthalic acid, di-ethoxylated Bisphenol A and ethylene glycol.

Said compound D for reacting with the reactive end group on the chain LPC in order to produce polymer A can be a long chain aliphatic compound or a polysiloxane. When using an aliphatic long chain compound as compound D, it is preferred to use a compound corresponding to the general formula

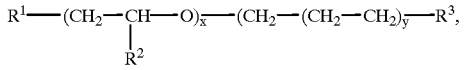

(I)

wherein $0 \leqq x \leqq 12$, $10 \leqq y \leqq 90$ and $R^1$ is a member selected from the group consisting of —OH, —COOH, —COCl, —$NH_2$,

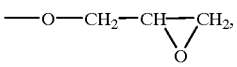

—NCO,

—O—$CH_2$—CHOH—$CH_2$Cl, —COO—$CH_2$—CHOH—$CH_2$Cl and COOM (with M is alkali metal ion), $R^2$ is $CH_3$ or H, preferably H, and $R^3$ is either $C_2H_5$ or $CH_3$.

It is was surprisingly found that toner particles, according to this invention, comprising a resinous matrix wherein, the polymer A is a polymer made by reacting polymeric chain LPC with a compound D according to formula I above, with $R^1$ is OH or COOH and x=0 and $55 \leqq y \leqq 90$, yielded very good results with respect to the combination of anti-hot-offset properties and fluidity in molten state.

Examples of monofunctional, hydroxyl terminated polyolefinic polymers, very useful for forming the crystalline or crystallizable terminal chain and/or side chains in an amorphous complex macromolecular compound according to the present invention, are polyolefinic monoalcohols, commercially available as UNILIN 425, UNILIN 550, UNILIN 700,(trade names of PETROLITE, 6910 East 14th street, TULSA, Okla. 74112, USA for polyolefinic alcohols with average molecular weight of 425, 700), or UNITHOX 720, a trade name for a hydroxyterminated, polyolefinicpolyoxyethylenic macromolecule, with average molecular weight of 875 of the same PETROLITE company. A typical example of a monofunctional carboxyl terminated polyolefine is UNICID 700 a trade name of PETROLITE for a polyolefinic monocarboxylic acid with average molecular weight of 700. Further experimental polyolefinic compounds, of PETROLITE, terminated by an hydroxyl group or a carboxyl group and having molecular weight between 1000 and 2500 can also be used.

It was further found that a polymer A for use in toner particles according to this invention could very beneficially be made by reacting a polymeric chain LPC with two different compounds D, one compound having a molecular weight between 400 and 1000 and one compound having a molecular weight between 1500 and 2500. A preferred combination of compounds D in this invention is the combination of a polyolefinic alcohol or polyolefinic carboxylic acid with molecular weight 700 or 1000 and a polyolefinic alcohol or polyolefinic carboxylic acid with molecular weight 2000. Such polymers have been disclosed in, e.g., EP-A-712 881.

When said compound D is a polysiloxane, it is preferably a polysiloxane it is preferred to use a polysiloxane corresponding to formula:

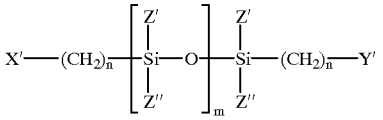

wherein

X' is

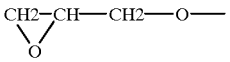

Y' has the same meaning as X', or represents a lower (C1 to C4) alkyl group,

Z' and Z", which may be the same or different, represent a lower (C1 to C4) alkyl group or an aryl group, $2<m<35$, and $1<n<6$.

Epoxy terminated polysiloxane derivatives, corresponding to the general formula above, are commercially available from Th. Goldschmid AG, Essen, Germany under trade names TEGOMER E-Si 2130 AND TEGOMER E-Si 2330.

When reacting said compound D with said polymeric chain (LPC) it is preferred to add 10 and 50% by weight of compound D with respect to the weight of the LPC that is used. It is also important that, in the polymer A, the molar ratio between the polymeric chain LPC and compound D is such that $0.8 \leqq LPC/D \leqq 1.25$.

The modification of the polymeric chain by compound D for forming polymer A, useful in toner particles of this invention, can proceed by two methods:

1. A method comprising the steps of
   (i) mixing a polymeric chain and at least one compound D in a reaction vessel (ii) heating said mixture, under nitrogen atmosphere, to a temperature between 150° C. and 250° C. under stirring (iii) continuing said heating until there is no longer a phase separation and (iv) cooling and recovering the polymer A.

2.A method comprising the steps of (i) mixing at least one compound D, with di-carboxylic acids, diols, if so desired diamines or lactams or mixtures thereof to form a polycondensation mixture (ii) forming a prepolymer by heating said polycondensation mixture, if so desired in the presence of proper catalysts, (iii) further reacting the prepolymer with a diol and/or a di-carboxylic acid until the desired visco-elasticity is reached and (iv) cooling the reaction mixture and recovering the polymer A.

The first method, which is preferred for modifying the polymer LPC for use in toner particles according to this invention, is a method wherein a finished chain polymer with a reactive end group is mixed with an amount of at least one compound D and then reacted together. In the second method, at least one compound D is mixed with the reagents for forming the polymeric chain (LPC) so that in a single pot synthesis the polymer A, useful in toner particles of this invention is directly obtained.

The polymer B in the resinous matrix is branched or partially cross-linked polymer, it can e.g. be an addition polymer carrying free hydroxyl of carboxyl groups that has been partially cross-linked by reaction with a polyisocyanate. It can be a styrene, acrylate or methacrylate co-polymer comprising between 1 and 10 mol % of moieties derived from divinylbenzene, or ethyleneglycoldiacrylate or ethyleneglycoldimethacrylate.

Preferably polymer B a branched polyester. To produce a branched polyester either polycarboxylic acids as, e.g. trimellitic acid, etc. or polyhydroxy compounds, as, e.g., trimethylolpropane, glycerol, pentaerythritol, etc. can be used. Interesting branched polyesters are polyester produced by the polycondensation of DIANOL 22 (di-ethoxylated Bisphenol A), DIANOL 33 (di-propoxylated Bisphenol A), terephthalic acid and trimellitic acid . DIANOL 22 and DIANOL 33 are trade names of AKZO CHEMIE of the Netherlands. When for use in the present invention the polymer B is a branched polyester it comprises preferably between 1 and 10 mol percent of moieties derived from a polyfunctional monomer The polymer B has preferably a tgδ between 1 and 2.5, when measured at 120° C. and 100 rad/sec. The polymer B, for use in toner particles of this invention has preferably a Tg larger than 45° C., preferentially larger than 50° C. and a Hildebrand solubility parameter between 19 and 22 $J^{1/2}/cm^{3/2}$.

The compound C for use in this invention may include the following. It may include aliphatic hydrocarbon waxes such as low-molecular weight polyethylene, low molecular weight polypropylene, microcrystalline wax and paraffin wax, oxides of aliphatic hydrocarbon waxes such as polyethylene wax oxide, and block copolymers thereof; waxes mainly composed as a fatty acid ester, such as carnauba wax and montanic acid ester wax; and those obtained by deoxidising part or the whole of a fatty acid ester, such as deoxidised carnauba wax. It may also include saturated straight-chain fatty acids such as palmitic acid, stearic acid and montanic acid; unsaturated fatty acids such as brassidic acid, oleostearic acid and patinatic acid; saturated alcohols such as stearyl alcohol, aralkyl alcohol, behenyl alcohol, carnaubyl alcohol, ceryl alcohol and melissyl alcohol; polyhydric alcohol such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; fatty acid metal salts (what is commonly called metal soaps) such as calcium stearate, calcium laurate, zinc stearate and magnesium stearate; waxes obtained by grafting vinyl monomers such as styrene or acrylic acid into fatty acid hydrocarbon waxes; partially esterified products of fatty acids such as behenic acid monoglyceride with polyhydric alcohols; and monomethyl ester compounds having a hydroxyl group, obtained by hydrogenation of vegetable fats and oils.

Examples of compounds C, useful in the resinous matrix of toner particles according to this invention, are waxes commercially available under trade name MITSUI HI-WAX 100P, MITSUI HI-WAX 110P, MITSUI HI-WAX 1105A, MITSUI HI-WAX 1120H, etc., from Mitsui Petrochemical Industries, Ltd Japan or under trade name HOECHST-WACHS U, HOECHST-WACHS PE520, HOECHST-WACHS PE130, HOECHST-WACHS PED 121, etc., from Hoechts, Germany.

Compound C, has preferably a molecular weight between 400 and 2,500, more preferably a molecular weight between 500 and 1,600.

It is beneficial for dry toner particles having a resinous matrix according to this invention that in this matrix more than one compound C is present. By carefully choosing the compounds C with respect to their melting point $M_{pC}$ and their softening point $T_{sC}$ it is possible to fine tune the anti-hot-offset properties, physical strength and fluidity in molten state of toner particles incorporating the resinous matrix.

Compounds C for use in this invention are chosen on the basis of the molecular weight, the melting point $M_{pC}$ and their softening point $T_{sC}$ and their Hildebrand solubility parameter $\delta_C$. When these values are within the values given above, i.e. when $M_p \leqq T_{sB}+10$ preferably $M_p \leqq T_{sB}+5$, wherein $T_{sB}$ is the softening point of polymer B, and when $T_{sC} \leqq T_{sB}+20$, preferably $T_{sC} \leqq T_{sB}+15$ and $\delta_C$ is between 15 and 19 $J^{1/2}/cm^{3/2}$,then not only a resinous matrix giving the toner particles the desired characteristics but also a resinous matrix wherein compound C (or more than one compound C) hare very homogeneously divided can be prepared. The homogeneity of the division of compound(s) C in the resinous matrix is tested by melting a sample of said matrix on a glass plate and observing the molten sample under a polarisation microscope. By this method it is possible to rank the blends of polymer A, B and compound C (i.e. several resinous matrices) according to their quality. In any case for have a good dispersion of compound(s) C in the resinous matrix it is preferred that polymer A and compound(s) C are present in a weight ratio between 1 and 10, more preferably between 2 and 5. The compounds C are preferably present in the resinous matrix of this invention in an amount between 2 and 8% weight for weight (wt/wt), more preferably in a amount between 4 and 6% wt/wt.

Toner particles according to this invention can be prepared by any method known in the art, but it is preferred to produced the toner particles according to this invention by a melt kneading process at a temperature that is higher than the melting point $M_p$compound C that is used. When more than one compound C is used the melt kneading proceeds preferably at a temperature higher than the highest melting point of the compounds C. Thus the present invention also encompasses a method for producing dry toner particles comprising the steps of:

mixing polymer A, being a polymer made by reacting a polymer chain (LPC) with a reactive end group and a long chain compound D, selected from the group consisting of long chain aliphatic compounds with a reactive end group and having between 20 and 250 carbon atoms and a polysiloxane, and the molar fraction of LPC/D in polymer A being such that $0.8 \leqq LPC/D \leqq 1.25$, with a polymer B having a viscoelastic loss tgδ such that $1.0 \leqq tg\delta \leqq 2.5$ measured at 120° C. and at 100 rad/sec, a softening point $T_{sB}$ such that 110° C.$\leqq T_{sB} \leqq$135° C. and with at least one compound C having a melting point $M_p$ so that 85° C.$\leqq M_p \leqq$135° C. and $M_p \leqq T_{sB}+10$, and a softening point $T_{sC}$ such that $T_{sC} \leqq T_{sB}+20$° C., an Hildebrand solubility parameter $\delta_C$ so that 15 $J^{1/2}/cm^{3/2} \leqq \delta_C \leqq 19$ J½/$cm^{3/2}$, forming a mixture of polymer A, polymer B and at least one compound C, melt kneading said mixture at a temperature higher than said melting point $MC_p$, and cooling said melt kneaded mixture.

The present invention comprises also a method for producing dry toner particles comprising the steps of mixing said polymer A, with at least one of said compounds C, melt kneading said mixture at a temperature higher than said melting point $M_p$, adding said polymer B to said mixture, continuing the melt kneading and cooling said melt kneaded mixture.

In the latter method, once the polymer A and the compound(s) C are melt kneaded at a temperature higher than the melting point(s) of the compound(s) C, it is not necessary that after the addition of polymer B the melt kneading continues at that elevated temperature.

Toner particles, comprising a resinous matrix, according to the present invention, can comprise any normal toner ingredient e.g. charge control agents, pigments both coloured and black, inorganic fillers, fine magnetic material, etc.. A description a charge control agents, pigments and other additives useful in toner particles, can be found in e.g. EP A 601 235.

Toner particles, comprising a resinous matrix, according to the present invention, when used in a multicomponent dry developer can be mixed with any known carrier material. Suitable carrier particles are carrier particles as disclosed in, e.g., EP-A-289 663; EP-A-559 250; EP-A-656 130 and European Application 97202551 filed on Aug. 20, 1997. Known fluidity enhancers as e.g. hydrophobized silica, can be mixed with said toner particles. The toner particles can be used as a monocomponent dry developer (both magnetic and non-magnetic) or mixed with carrier particles to form a multi component developer.

Toner particles, comprising a resinous matrix, according to the present invention, can have an average volume diameter between 1 and 50 μm, preferably between 3 and 20 μm and more preferably between 3 and 10 μm. The particle size distribution of said toner particles can be of any type. It is however preferred to have a Gaussian or normal particle size distribution, either by number or volume, with a coefficient of variability (standard deviation divided by the average) (v) smaller than 0.5, more preferably of 0.3. The toner particles can have any shape, the particles can irregular, rounded, etc.

Toner particles according to this invention are especially useful for use in electrostatographic or magnetographic imaging methods wherein the fixing proceeds in a "contact fusing" station and wherein a very low amount of external release agent is applied to the heated rollers of the fusing station to prevent hot-offset. Thus the toner particles of this invention are used an imaging method using dry toner particles comprising the steps of:

image-wise applying said toner particles to a final image receiving substrate and fixing said toner particles to said substrate in a fusing station comprising heated rollers having a surface with Si-atoms, characterised in that on said surface of said heated rollers an external release agent is added in such an amount that at most 160 $mg^2$ of release agent is applied to said substrate. Preferably the amount is such that at most 80 $mg/m^2$ of release agent is applied to said substrate and more preferably at most 40 $mg/m^2$ is applied.

The amount of release agent is preferably applied to the heated rollers by a supply roller with a surface in NOMEX-felt (NOMEX is a trade name of Du Pont de Nemours, Wilmington, US) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, US 1995. When using such rollers typically between 1 and 10 mg external release agent per $m^2$ are applied. Thus using toner particles according to this invention, the contact fusing can proceed without problems with hot-offset even when only between 1 and 10 $mg/m^2$ of external release agent is applied.

It is in principle even possible to use toner particles according to this invention in imaging methods incorporating a "contact fusing" station with heated rollers, wherein NO external release agent (NO external release agent means for the purposes of this document less than 1 $mg/m^2$) is applied to the heated rollers.

The heated rollers can be made from any material known in the art, but can preferably be heated rollers with a surface comprising compounds selected from the group consisting of compounds containing Si-atoms and compounds containing F-atoms. Rollers having a surface with both compounds containing Si-atoms and compounds containing F-atoms at the surface and rollers comprising compounds with F-atoms at the surface but not compounds with Si-atoms are very well suited for fixing toner particles according to this invention.

EXAMPLES

Modification of polymer LPC by modifier D

1. Preparation of polymer A1

70 part by weight (wt/wt) of polymer chain (LPC) being a commercial linear polyester, sold under trade name ATLAC T500 (acid value 20, $M_w$=12,000, $M_n$=4,000, $T_{sp}$ of 100° C. a tgδ=7 at 120° C. and 100 rad/sec and a-Hildebrand value of 20$J^{1/2}/cm^{3/2}$) and 10 parts wt/wt of UNILIN700 (a monofunctional polyolefinic molecule, consisting of —$CH_2$—$CH_2$— groups terminated at one side with a —$CH_3$ group and at the other by a HO-group, having an average molecular weight of 700 and a Hildebrand value of 17 $J^{1/2}/cm^{3/2}$) and 20 part wt/wt of an experimental homologue, with molecular weight Mw=2000 and a Hildebrand value of 17 $J^{1/2}/cm^{3/2}$, were mixed in a reaction vessel. Thus together with one LPC, two different compounds D were present. The mixture was heated during 30 minutes at 245° C. and stirred by a nitrogen flow bubbling through the reaction mixture. During this reaction time the water, formed by the reaction was distilled away. This gave a polymer Al with a weight average molecular weight $M_W$ around 12,000 was obtained.

2. Preparation of polymer A2

70 part by weight (wt/wt) of polymer chain (LPC) being polyester, made of bis-propoxylated 2,2-bis(4-hydroxyphenyl)propane (A), bis-ethoxylated 2,2-bis(4-hydroxyphenyl)propane (B),terephthalic acid (C) and trimellitic acid (D), wherein A/B=70 mol %/30 mol %, C/D=60 mol %/40 mol % and A+B/C+D=100 mol %/70 mol %. This polyester had an acid value of 30, $M_w$=14,000, $M_n$=2,000, $T_{sp}$ of 105° C., a tgδ=4.5 at 120° C. and 100 rad/sec and a Hildebrand value of 20 $J^{1/2}/cm^{3/2}$) and 10 parts wt/wt of UNILIN700 (a monofunctional polyolefinic molecule, consisting of —$CH_2$—$CH_2$— groups terminated at one side with a —$CH_3$ group and at the other by a HO-group, having an average molecular weight of 700 and a Hildebrand value of 17 $J^{1/2}/cm^{3/2}$) and 20 part wt/wt of an experimental homologue, with molecular weight Mw=2000 and a Hildebrand value of 17 $J^{1/2}/cm^{3/2}$, were mixed in a reaction vessel. Thus together with one LPC, two different compounds D were present. The mixture was heated during 30 minutes at 245° C. and stirred by a nitrogen flow bubbling through the reaction mixture. During this reaction time the water, formed by the reaction was distilled away. This gave a polymer A2 with a weight average molecular weight $M_w$ around 12,000 was obtained.

Preparation of the toner particles

Toner particles TON1

60 parts wt/wt of the polymer Al above, were mixed with 30 parts by weight of polymer B, a cross-linked polyester of bis-ethoxylated 2,2-bis(4-hydroxyphenyl)propane, bis-propoxylated 2,2-bis(4-hydroxyphenyl)propane, terephthalic acid and trimellitic acid with a softening point of 118° C., a tgδ=2 at 120° C. and 100 rad/sec and a Hildebrand solubility factor of 20 $J^{1/2}/cm^{3/2}$. To this mixture 3 parts by weight of a cyan Cu-phtalocyanine pigment and 7 parts by weight of a polyolefine wax with a molecular weight around 2,000, a melting point determined by DSC of 122° C. and a softening point determined by the JISK2207 test method of 130° C., and a Hildebrand solubility factor of 16 $J^{1/2}/cm^{3/2}$ were added.

The mixture was melt homogenised at 130° C., cooled and pulverised, classified to give cyan toner particles volume average diameter $d_{v50}$ 8.5 μm, as determined by COULTER COUNTER (trade name), and numerical average diameter $d_{n50}$ of 6.3 μm.

Toner particles TON2

60 parts wt/wt of the polymer A2 above, were mixed with 30 parts by weight of polymer B, a cross-linked polyester of bis-ethoxylated 2,2-bis(4-hydroxyphenyl)propane, bis-propoxylated 2,2-bis(4-hydroxyphenyl)propane, terephthalic acid and trimellitic acid with a softening point of 118° C., a tgδ=2 at 120° C. and 100 rad/sec and a Hildebrand solubility factor of 20 $J^{1/2}/cm^{3/2}$. To this mixture 3 parts by weight of a cyan Cu-phtalocyanine pigment and 7 parts by weight of a polyolefine wax with a molecular weight around 2,000, a melting point determined by DSC of 122° C. and a softening point determined by the JISK2207 test method of 130° C., and a Hildebrand solubility factor of 16 $J^{1/2}/cm^{3/2}$ were added.

The mixture was melt homogenised at 130° C., cooled and pulverised, classified to give cyan toner particles volume average diameter $d_{v50}$ 8.5 μm, as determined by COULTER COUNTER (trade name), and numerical average diameter $d_{n50}$ of 6.3 μm.

Toner particles TON2

The preparation of toner particles TON1 was repeated, except that the polymer chain (LPC) was NOT modified.

Toner particles TON4

The preparation of toner particles TON3 was repeated except for the fact that NO wax was added.

Toner particles TON5

The preparation of toner particles TON1 was repeated except for the fact that NO wax was added.

Preparation of the developer

With each of the toner particles (TON1 to TON5) a developer was prepared by adding 0.5% (wt/wt)of AEROSIL R972 5(trade name of Degussa, Germany) for hydrophobic silica and mixing 5% wt/wt of this toner particles and silica mixture with silicone-coated ferrite carrier particles with average volume particle diameter dv50 of 50 μm Printing and fixing examples The developers were used to produce images on a paper substrate in the XC305 colour copier (trade name of Agfa-Gevaert N.V, Mortsel, Belgium). The images contained 1 mg of toner per cm2. The images were fixed in four different "contact fusing" stations A to D, comprising heated rollers. Basically the fusing device of said XC305 colour copier was used with certain modifications. In the standard design, the fusing station of this apparatus comprises a dual silicone coated roller pair, showing a typical 5–6 mm contact zone. The temperature setting was made changeable in the range of 160–175° C., so as to make it a variable parameter in the examples. In all examples the fusing proceeded under the conditions of speed and pressure of the standard design of the apparatus.

Fusing station A:

The standard oiling device, supplying normally between 40–80 mg silicone oil per copy on a DIN A4 page,, (i.e. 640 to 1,280 $mg/m^2$, all scraping devices and the cleaning web were taken out of the fusing station. The heated rollers were rollers with a silicone surface and with lifetime of 5,000 copies. In this fusing station, contact fusing proceeded without having an external release agent on the heated rollers.

Fusing station B

The same set-up as for fusing station A was used, except that heated rollers with a lifetime of 50,000 copies were used. Also in this fusing station, contact fusing proceeded without having an external release agent on the heated rollers.

Fusing station C

The same set-up as for fusing station B was used, except for the fact that on the heated rollers a small amount of external release agent (silicone oil) was applied to the heated rollers. The amount of silicone oil to be delivered to the heated rollers was adjusted so as to bring 1.6 mg of silicone oil per $m^2$ on the image. This is 40 to 80 times less than what is usual. The silicone oil was applied to the heated rollers by supply rollers with a surface in NOMEX-felt (NOMEX is a trade name of Du Pont de Nemours, Wilmington, US) as described in article titled "Innovative Release Agent Delivery Systems" by R. Bucher et al. in The proceedings of IS&T's Eleventh International Congress on Advances in Non-Impact Printing Technologies, page 219–222. This congress was held in Hilton Head, from 29.10.95 to 03.11.95. The proceedings are published by IS&T, Springfield, US 1995.

Fusing station D:

The same set-up as in fusing station C was used, except for the fact that instead of rollers with a pure silicone surface, rollers with a silicone, polyflouraacrylate surface were used. These rollers are very resistance to scratching and have a lifetime of about 500,000 copies. The rollers have however a higher surface energy and can more easily than rollers with silicone surface induce hot-offset.

For each of the fusing stations, the fixing window was determined. First the fixing temperature at which the fixing was adequate was noted as Ti. This was done by printing an image with the various toners, fixing the images at differrent temperatures and assesing the fixing quality reached by evaluating them on four topics :

Image quality:visual inspection

Smoothness:visual inspection

Feel:feeling the surface of the image

Toner adherence : manually scratching the toner away with a plastic knife.

The evaluation proceeded for each of the topics on a scale from 4 to 1, with 4 very good, 3 good, 2 marginal and 1 unacceptable. The fixing was taken to be adequate when the image got at least a marking 3 for each of the topics above. The fixing temperature of that image was taken as temperature T1.

Then fixing proceeded at still higher temperatures and the temperature T2 when the first sign of hot-offset emerged was noted. The fixing window was determined by substracting T1 from T2 and is given in °C. Since fixing station A and B both operated without external release agent and fixing stations C and D with a small amount of external fixing agent, the fixing windows for each of the toner particles TON1 to TON5 obtained in fixing stations A and B were averaged to give a single figure for the fixing window when no external agent is present, similarly the fixing windows for each of the toner particles TON1 to TON5 obtained in fixing stations C and D were averaged to give a single figure for the fixing window when some external agent is present. These figures are summarized in table 1.

TABLE 1

| | Fixing window ° C. | |
|---|---|---|
| Toner # | No release agent | With release agent |
| TON1 | 35 | 40 |
| TON2 | 35 | 40 |
| TON3 | 15 | 20 |
| TON4 | 10 | 20 |
| TON5 | 4 | 20 |

It is clear that toner particles TON1 and TON2, toner particles according to this invention give the best results the widest fixing window and the best image quality.

Toner particles TON3, equal to toner particles TON1, except for the fact that the polymeric chain LPC was not modified by a compound D, and thus non-invention toner particles, gave a less wide fixing window.

The other two non-invention toner particles (ton4 and ton5) gave clearly unsatisfactory results.

What is claimed is:

1. Dry toner particles comprising a resinous matrix and a wax, wherein:

said resinous matrix consists of a mixture of a linear polymer (LPC) with weight average molecular weight (Mw) between 2,000 and 20,000, a tgδ>3 at 120° C. and 100 rad/sec and a low softening point $T_{sLPC}$ such that 90° C.≦$T_{sLP}$≦120° C., modified by a modifier (D) selected from the group consisting of long chain aliphatic compounds with a reactive end group and having between 20 and 250 carbon atoms and a polysiloxane to form polymer A, said modifier and said polymer being resent in a molar ratio LPC/D between 0.8 and 1.25 and a non-linear polymer B with a softening point TsB such that 110° C.≦$T_{sB}$≦135° C. making up at least 25% by weight of said resinous matrix, and said wax C has a melting point Mp so that 85° C.≦$M_p$≦135° C. and Mp≦$T_{sB}$+10.

2. Dry toner particles according to claim 1, wherein said polymer B further has a viscoelastic loss tgδ such that 1.0≦tgδ≦2.5 measured at 120° C. and at 100 rad/sec, said wax has further a softening point $T_{sC}$ such that $T_{sC}$≦$T_{sB}$+20° C., and an Hildebrand solubility parameter $\delta_C$ so that 15 $J^{1/2}/cm^{3/2}$≦$\delta_C$≦19 $J^{1/2}/cm^{3/2}$ and wherein said polymer B, said linear polymeric chain LPC and said compounds C and D have a Hildebrand solubility parameter δ such that $\delta_C=\delta_D<\delta_{LPC}=\delta_B$.

3. Dry toner particles according to claim 1, wherein said long polymeric chain, LPC, is a linear polyester.

4. Dry toner particles according to claim 1, wherein said long chain compound D is an long chain aliphatic compound with formula:

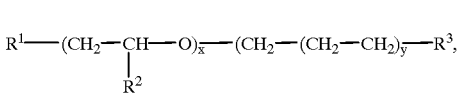

(I)

wherein 0≦x≦12, 10≦y≦90 and $R^1$ is a member selected from the group consisting of —OH, —COOH, —COCl, —$NH_2$,

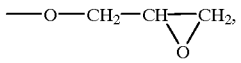

—O—$CH_2$—CHOH—$CH_2$Cl, —COO—$CH_2$—CHOH—$CH_2$Cl and COOM, $R^2$ is selected from the group consisting of $CH_3$ and H, and $R^3$ is selected from the group consisting of $C_2H_5$ and $CH_3$.

5. Dry toner particles according to claim 1, wherein said long chain compound D is a polysiloxane with formula:

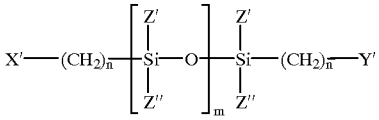

wherein

X' is

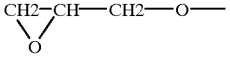

Y' has the same meaning as X', or represents a lower (C1 to C4) alkyl group,

Z' and Z", which may be the same or different, represent a lower (C1 to C4) alkyl group or an aryl group, 2<m<35, and 1<n<6.

6. Dry toner particles according to claim 5, wherein Y' is methyl, n=3 and m=10.

7. Dry toner particles according to claim 1, wherein said polymer B is a cross-linked polyester comprising between 1 and 10 mol % of moieties derived from a monomer selected from the group of tri-carboxylic acids and tri-hydroxy compounds.

8. Dry toner particles according to claim 1, wherein said polymer B B is a branched addition polymer.

9. Dry toner particles according to claim 8, wherein said polymer B is a branched addition polymer comprising between 1 and 10 mol % of moieties derived from a monomer selected from the group consisting of divynilbenzene, ethyleneglycoldiacrylate and ethyleneglycoldimethacrylate.

10. Dry toner particles according to claim 1, wherein said polymer A and said compound C are present in a weight ratio such that $1 \leqq A/C \leqq 10$.

11. Dry toner particles according to claim 1, wherein said polymer A and said compound C are present in a weight ratio such that $2 \leqq A/C \leqq 5$.

12. An imaging method using dry toner particles comprising the steps of:

image-wise applying said toner particles on a surface of a final image receiving substrate and fixing said toner particles to said surface in a fusing station comprising heated rollers, wherein said toner particles comprise a resinous matrix and a wax, wherein said resinous matrix consists of a mixture of a linear polymer (LPC) with weight average molecular weight (Mw) between 2,000 and 20,000, a tgδ>3 at 120° C. and 100 rad/sec and a low softening point $T_{sLPC}$ such that 90° C.$\leqq T_{sLPC} \leqq$120° C., modified by a modifier (D) selected from the group consisting of long chain aliphatic compounds with a reactive end group and having between 20 and 250 carbon atoms and a polysiloxane to form polymer A, said modifier and said polymer being present in a molar ratio LPC/D between 0.8 and 1.25 and a non-linear polymer with a softening point TsB such that 110° C.$\leqq T_{sB} \leqq$135° C. making up at least 25% by weight of said resinous matrix, and said wax has a melting point Mp so that 85° C. $\leqq$135° C. and $Mp \leqq T_{sB}+10$ and on said surface of said heated rollers an external release agent is added in such an amount that at most 160 mg/m$^2$ of release agent is applied to said final image receiving substrate.

13. A method according to claim 12, wherein said heated rollers have a surface whereon an external release agent is added in such an amount that at most 40 mg/m$^2$ of release agent is applied to said final image receiving substrate.

14. A method according to claim 12, wherein said heated rollers have a surface whereon an external release agent is added in such an amount that between 1 and 10 mg/m$^2$ of release agent is applied to said final image receiving substrate.

15. A method according to claim 12, wherein said heated rollers have a surface whereon no external release agent is applied.

16. A method according to claim 12, wherein said heated rollers have a surface comprising F-atoms.

17. A method according to claim 16, wherein said surface comprises no Si-atoms.

* * * * *